US008286698B2

(12) United States Patent
Ware et al.

(10) Patent No.: US 8,286,698 B2
(45) **Date of Patent: *Oct. 16, 2012**

(54) METHOD FOR PRODUCING VISCOUS HYDROCARBON USING STEAM AND CARBON DIOXIDE

(75) Inventors: Charles H. Ware, Palm Harbor, FL (US); Myron I. Kuhlman, Houston, TX (US)

(73) Assignee: World Energy Systems Incorporated, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/253,783

(22) Filed: Oct. 5, 2011

(65) Prior Publication Data

US 2012/0067573 A1 Mar. 22, 2012

Related U.S. Application Data

(63) Continuation of application No. 11/358,390, filed on Feb. 21, 2006, now Pat. No. 8,091,625.

(51) Int. Cl.
*E21B 36/02* (2006.01)
*E21B 43/24* (2006.01)

(52) U.S. Cl. ..... 166/59; 166/302; 166/369; 166/263

(58) Field of Classification Search ..... 166/58, 166/59

See application file for complete search history.

(56) References Cited

U.S. PATENT DOCUMENTS 3,456,721 A 7/1969 Smith
3,700,035 A 10/1972 Lange
3,736,249 A 5/1973 Lawson
3,770,398 A 11/1973 Abraham et al.
3,772,881 A 11/1973 Lange
3,872,924 A 3/1975 Clampitt
3,980,137 A 9/1976 Gray
3,982,591 A 9/1976 Hamrick et al.
3,982,592 A 9/1976 Hamrick et al.
3,986,556 A 10/1976 Haynes
4,024,912 A 5/1977 Hamrick et al.
4,026,357 A 5/1977 Redford
4,050,515 A * 9/1977 Hamrick et al. ..... 166/303
4,053,015 A 10/1977 Hamrick et al.
4,068,715 A 1/1978 Wu
4,077,469 A 3/1978 Hamrick et al.
4,078,613 A 3/1978 Hamrick et al.

(Continued)

FOREIGN PATENT DOCUMENTS

CA 2335737 A1 12/1999

(Continued)

OTHER PUBLICATIONS

"Combustion." Wikipedia, the free encyclopedia, retrieved Dec. 11, 2007 from http://en.wikepedia.org.

(Continued)

*Primary Examiner* — Angela M DiTrani
(74) *Attorney, Agent, or Firm* — Patterson & Sheridan, L.L.P.

(57) ABSTRACT

A downhole burner is used for producing heavy-oil formations. Hydrogen, oxygen, and steam are pumped by separate conduits to the burner, which burns at least part of the hydrogen and forces the combustion products out into the earth formation. The steam cools the burner and becomes superheated steam, which is injected along with the combustion products into the earth formation. Carbon dioxide is also pumped down the well and injected into the formation.

22 Claims, 3 Drawing Sheets

U.S. PATENT DOCUMENTS

| | | | | |
|---|---|---|---|---|
| 4,114,688 | A | 9/1978 | Terry | |
| 4,121,661 | A | 10/1978 | Redford | |
| 4,148,359 | A | 4/1979 | Laumbach et al. | |
| 4,156,462 | A | 5/1979 | Allen | |
| 4,159,743 | A | 7/1979 | Rose et al. | |
| 4,163,580 | A | 8/1979 | Pearson et al. | |
| 4,166,501 | A | 9/1979 | Korstad et al. | |
| 4,199,024 | A | 4/1980 | Rose et al. | |
| 4,233,166 | A | 11/1980 | Allen | |
| 4,271,905 | A | 6/1981 | Redford et al. | |
| 4,330,038 | A | 5/1982 | Soukup et al. | |
| 4,336,839 | A | 6/1982 | Wagner et al. | |
| 4,366,860 | A | 1/1983 | Donaldson et al. | |
| 4,380,267 | A | 4/1983 | Fox | |
| 4,385,661 | A | 5/1983 | Fox | |
| 4,410,042 | A | 10/1983 | Shu | |
| 4,411,618 | A | 10/1983 | Donaldson et al. | |
| 4,427,066 | A | 1/1984 | Cook | |
| 4,429,744 | A | 2/1984 | Cook | |
| 4,442,898 | A | 4/1984 | Wyatt | |
| 4,456,068 | A | 6/1984 | Burrill, Jr. et al. | |
| 4,459,101 | A | 7/1984 | Doherty | |
| 4,463,803 | A | 8/1984 | Wyatt | |
| 4,475,883 | A | 10/1984 | Schirmer et al. | |
| 4,487,264 | A | 12/1984 | Hyne et al. | |
| 4,501,445 | A | 2/1985 | Gregoli | |
| 4,558,743 | A | 12/1985 | Ryan et al. | |
| 4,565,249 | A | 1/1986 | Pebdani et al. | |
| 4,589,487 | A | 5/1986 | Venkatesan et al. | |
| 4,597,441 | A * | 7/1986 | Ware et al. | 166/261 |
| 4,604,988 | A | 8/1986 | Rao | |
| 4,610,304 | A | 9/1986 | Doscher | |
| 4,648,835 | A | 3/1987 | Eisenhawer et al. | |
| 4,678,039 | A | 7/1987 | Rivas et al. | |
| 4,691,771 | A | 9/1987 | Ware et al. | |
| 4,706,751 | A | 11/1987 | Gondouin | |
| 4,765,406 | A | 8/1988 | Frohling et al. | |
| 4,819,724 | A | 4/1989 | Bou-Mikael et al. | |
| 4,860,827 | A | 8/1989 | Lee et al. | |
| 4,861,263 | A | 8/1989 | Schirmer | |
| 4,865,130 | A | 9/1989 | Ware et al. | |
| 4,930,454 | A | 6/1990 | Latty et al. | |
| 5,055,030 | A | 10/1991 | Schirmer | |
| 5,085,276 | A | 2/1992 | Rivas et al. | |
| 5,163,511 | A | 11/1992 | Amundson et al. | |
| 5,305,829 | A | 4/1994 | Kumar | |
| 5,488,990 | A | 2/1996 | Wadleigh et al. | |
| 5,725,054 | A | 3/1998 | Shayegi et al. | |
| 6,016,867 | A | 1/2000 | Gregoli et al. | |
| 6,016,868 | A | 1/2000 | Gregoli et al. | |
| 6,328,104 | B1 * | 12/2001 | Graue | 166/259 |
| 6,358,040 | B1 | 3/2002 | Pfefferle et al. | |
| 7,090,013 | B2 | 8/2006 | Wellington | |
| 7,341,102 | B2 | 3/2008 | Kresnyak et al. | |
| 7,343,971 | B2 | 3/2008 | Pfefferle | |
| 7,497,253 | B2 | 3/2009 | Retallick et al. | |
| 8,091,625 | B2 * | 1/2012 | Ware et al. | 166/59 |
| 2002/0036086 | A1 | 3/2002 | Minkkinen et al. | |
| 2005/0239661 | A1 | 10/2005 | Pfefferle | |
| 2006/0042794 | A1 | 3/2006 | Pfefferle | |
| 2006/0162923 | A1 | 7/2006 | Ware | |
| 2006/0289157 | A1 | 12/2006 | Rao | |
| 2007/0193748 | A1 | 8/2007 | Ware et al. | |
| 2007/0202452 | A1 | 8/2007 | Rao | |
| 2009/0145606 | A1 | 6/2009 | Hocking | |

FOREIGN PATENT DOCUMENTS

| | | | |
|---|---|---|---|
| CA | 2335771 | A1 | 12/1999 |
| CA | 2363909 | A1 | 5/2003 |
| WO | WO-2007/098100 | A2 | 8/2007 |

OTHER PUBLICATIONS

PCT Search Report, International Application No. PCT/US07/04263, dated Oct. 15, 2008.

Robert M. Schirmer and Rod L. Eson, A Direct-Fired Downhole Steam Generator—From Design to Field Test, Society of Petroleum Engineers, Oct. 1985, pp. 1903-1908.

First Office Action dated Jul. 21, 2011 for Mexican Patent Application No. MX/a/2008/010764.

First Office Action dated Dec. 7, 2011for Chinese Patent Application No. 200780014387.4.

* cited by examiner

METHOD FOR PRODUCING VISCOUS HYDROCARBON USING STEAM AND CARBON DIOXIDE

CROSS-REFERENCE TO RELATED APPLICATIONS

This application is a continuation of U.S. patent application Ser. No. 11/358,390, filed Feb. 21, 2006, which issued as U.S. Pat. No. 8,091,625 and is herein incorporated by reference.

BACKGROUND OF THE INVENTION

Field of the Invention

This invention relates in general to methods for producing highly viscous hydrocarbons, and in particular to pumping partially-saturated steam to a downhole burner to superheat the steam and injecting the steam and carbon dioxide into a horizontally or vertically fractured zone.

There are extensive viscous hydrocarbon reservoirs throughout the world. These reservoirs contain a very viscous hydrocarbon, often called "tar", "heavy oil", or "ultraheavy oil", which typically has viscosities in the range from 3,000 to 1,000,000 centipoise when measured at 100 degrees F. The high viscosity makes it difficult and expensive to recover the hydrocarbon. Strip mining is employed for shallow tar sands. For deeper reservoirs, heating the heavy oil in situ to lower the viscosity has been employed.

In one technique, partially-saturated steam is injected into a well from a steam generator at the surface. The heavy oil can be produced from the same well in which the steam is injected by allowing the reservoir to soak for a selected time after the steam injection, then producing the well. When production declines, the operator repeats the process. A downhole pump may be required to pump the heated heavy oil to the surface. If so, the pump has to be pulled from the well each time before the steam is injected, then re-run after the injection. The heavy oil can also be produced by means of a second well spaced apart from the injector well.

Another technique uses two horizontal wells, one a few feet above and parallel to the other. Each well has a slotted liner. Steam is injected continuously into the upper well bore to heat the heavy oil and cause it to flow into the lower well bore. Other proposals involve injecting steam continuously into vertical injection wells surrounded by vertical producing wells.

U.S. Pat. No. 6,016,867 discloses the use of one or more injection and production boreholes. A mixture of reducing gases, oxidizing gases, and steam is fed to downhole-combustion devices located in the injection boreholes. Combustion of the reducing-gas, oxidizing-gas mixture is carried out to produce superheated steam and hot gases for injection into the formation to convert and upgrade the heavy crude or bitumen into lighter hydrocarbons. The temperature of the superheated steam is sufficiently high to cause pyrolysis and/or hydrovisbreaking when hydrogen is present, which increases the API gravity and lowers the viscosity of the hydrocarbon in situ. The '867 patent states that an alternative reducing gas may be comprised principally of hydrogen with lesser amounts of carbon monoxide, carbon dioxide, and hydrocarbon gases.

The '867 patent also discloses fracturing the formation prior to injection of the steam. The '867 patent discloses both a cyclic process, wherein the injection and production occur in the same well, and a continuous drive process involving pumping steam through downhole burners in wells surrounding the producing wells. In the continuous drive process, the '867 patent teaches to extend the fractured zones to adjacent wells.

SUMMARY OF THE INVENTION

A downhole burner is secured in the well. The operator pumps a fuel, such as hydrogen, into the burner and oxygen to the burner by a separate conduit from the fuel. The operator burns the fuel in the burner and creates superheated steam in the burner, preferably by pumping partially-saturated steam to the burner. The partially-saturated steam cools the burner and becomes superheated. The operator also pumps carbon dioxide into or around the combustion chamber of the burner and injects the carbon dioxide and superheated steam into the earth formation to heat the hydrocarbon therein.

Preferably, the operator initially fractures the well to create a horizontal or vertical fractured zone of limited diameter. The fractured zone preferably does not intersect any drainage or fractured zones of adjacent wells. The unfractured formation surrounding the fractured zone impedes leakage of gaseous products from the fractured zone during a soak interval. During the soak interval, the operator may intermittently pump fuel and steam to the burner to maintain a desired amount of pressure in the fractured zone.

After the soak interval, the operator opens valves at the wellhead to cause the hydrocarbon to flow into the borehole and up the well. The viscous hydrocarbon, having undergone pyrolysis and/or hydrovisbreaking during this process, flows to the surface for further processing. Preferably, the flow occurs as a result of solution gas created in the fractured zone from the steam, carbon dioxide and residual hydrogen. A downhole pump could also be employed. The carbon dioxide increases production because it is more soluble in the heavy hydrocarbon than steam or hydrogen or a mixture thereof. This solubility reduces the viscosity of the hydrocarbon, and carbon dioxide adds more solution gas to drive the production. Preferably, the portions of the carbon dioxide and hydrogen and warm water returning to the surface are separated from the recovered hydrocarbon and recycled. In some reservoirs, the steam reacts with carbonate in the rock formation and releases carbon dioxide, although the amount released is only a small percentage of the desired amount of carbon dioxide entering the heavy-oil reservoir.

When production declines sufficiently, the operator may repeat the procedure of injecting steam, carbon dioxide and combustion products from the burner into the fractured zone. The operator may also fracture the formation again to enlarge the fractured zone.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
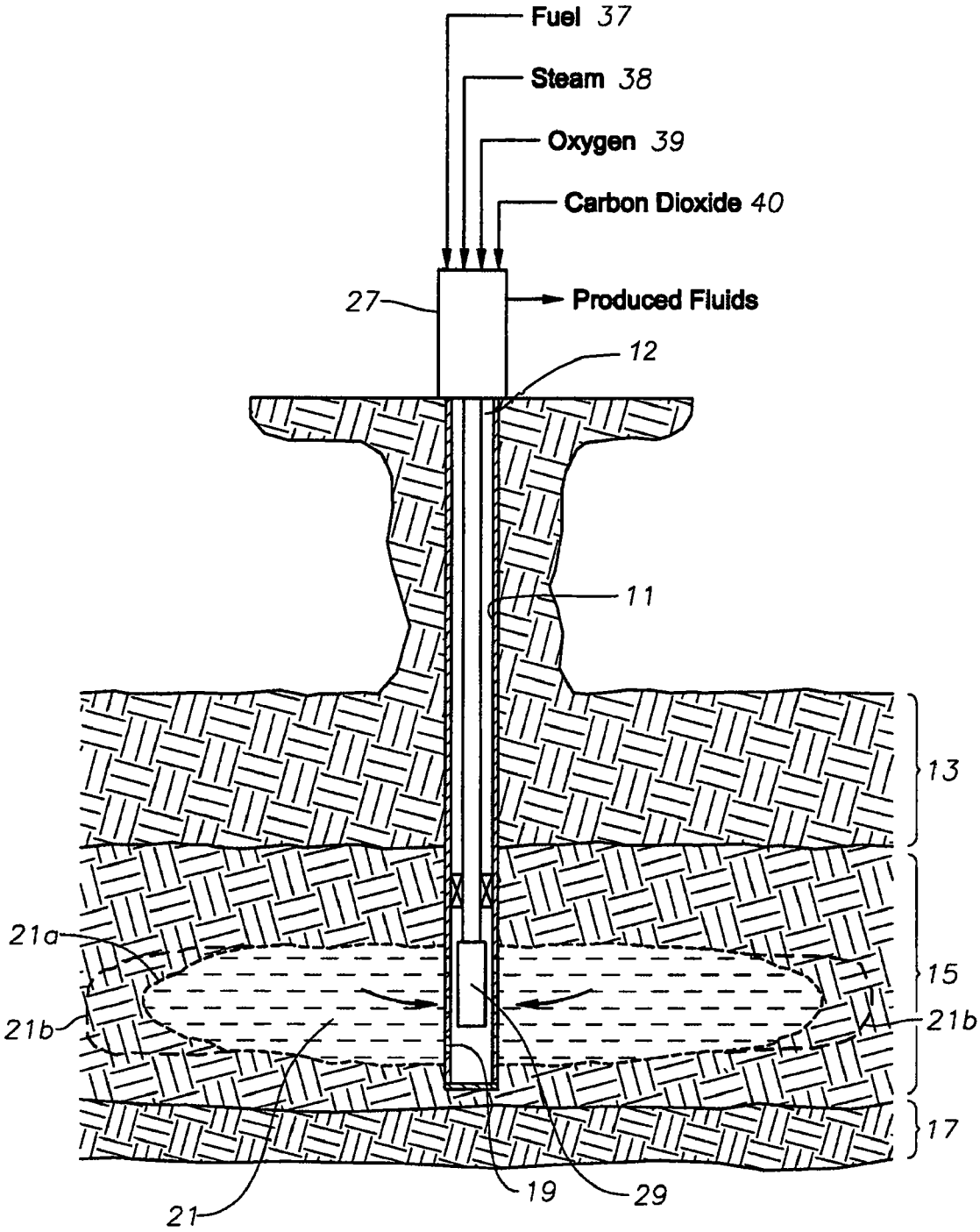
FIG. 1 is a schematic illustrating a well and a process for producing heavy oil in accordance with this invention.

Referring to FIG. 1, well 11 extends substantially vertically through a number of earth formations, at least one of which includes a heavy oil or tar formation 15. An overburden earth formation 13 is located above the oil formation 15. Heavy-oil formation 15 is located over an underburden earth formation 17. The heavy-oil formation 15 is typically a tar sand containing a very viscous hydrocarbon, which may have a viscosity from 3,000 cp to 1,000,000 cp, for example. The overburden formation 13 may be various geologic formations, for example, a thick, dense limestone that seals and imparts a relatively-high, fracture pressure to the heavy-oil formation 15. The underburden formation 17 may also be a thick, dense limestone or some other type of earth formation.

As shown in FIG. 1, the well is cased, and the casing has perforations or slots 19 in at least part of the heavy-oil formation 15. Also, the well is preferably fractured to create a fractured zone 21. During fracturing, the operator pumps a fluid through perforations 19 and imparts a pressure against heavy-oil formation 15 that is greater than the parting pressure of the formation. The pressure creates cracks within formation 15 that extend generally radially from well 11, allowing flow of the fluid into fractured zone 21. The injected fluid used to cause the fracturing may be conventional, typically including water, various additives, and proppant materials such as sand or ceramic beads or steam itself can sometimes be used.

In one embodiment of the invention, the operator controls the rate of injection of the fracturing fluids and the duration of the fracturing process to limit the extent or dimension of fractured zone 21 surrounding well 11. Fractured zone 21 has a relatively small initial diameter or perimeter 21*a*. In reference to FIGS. 1 and 2, the perimeter 21*a* of fractured zone 21 is limited such that it will not intersect any existing or planned fractured or drainage zones 25 of adjacent wells 23 that extend into the same heavy-oil formation 15. Further, in the preferred method, the operator will later enlarge fractured zone 21 surrounding well 11, thus the initial perimeter 21*a* should leave room for a later expansion of fractured zone 21 without intersecting drainage zone 25 of adjacent well 23. Adjacent well 23 optionally may previously have undergone one or more of the same fracturing processes as well 11, or the operator may plan to fracture adjacent well 23 in the same manner as well 11 in the future. Consequently, fractured zone perimeter 21*a* does not intersect fractured zone 25. Preferably, fractured zone perimeter 21*a* extends to less than half the distance between wells 11, 23. Fractured zone 21 is bound by unfractured portions of heavy-oil formation 15 outside perimeter 21*a* and both above and below fractured zone 21. The fracturing process to create fractured zone 21 may be done either before or after installation of a downhole burner 29, discussed below. If after, the fracturing fluid will be pumped through burner 29.

A production tree or wellhead 27 is located at the surface of well 11 in FIG. 1. Production tree 27 is connected to a conduit or conduits for directing fuel 37, steam 38, oxygen 39, and carbon dioxide 40 down well 11 to burner 29. Fuel 37 may be hydrogen, methane, syngas, or some other fuel. Fuel 37 may be a gas or liquid. Preferably, steam 38 is partially-saturated steam, having a water vapor content up to about 50 percent. The water vapor content could be higher, and even water could be pumped down well 11 in lieu of steam, although it would be less efficient. Wellhead 27 is also connected to a conduit for delivering oxygen down well 11, as indicated by the numeral 39. Fuel 37 and steam 38 may be mixed and delivered down the same conduit, but fuel 37 should be delivered separately from the conduit that delivers oxygen 39.

Because carbon dioxide 40 is corrosive if mixed with steam, preferably it flows down a conduit separate from the conduit for steam 38. Carbon dioxide 40 could be mixed with fuel 37 if the fuel is delivered by a separate conduit from steam 38. The percentage of carbon dioxide 40 mixed with fuel 37 should not be so high so as to significantly impede the burning of the fuel. If the fuel is syngas, methane or another hydrocarbon, the burning process in burner 29 creates carbon dioxide. In some instances, the amount of carbon dioxide created by the burning process may be sufficient to eliminate the need for pumping carbon dioxide down the well.

The conduits for fuel 37, steam 38, oxygen 39, and carbon dioxide 40 may comprise coiled tubing or threaded joints of production tubing. The conduit for carbon dioxide 40 could comprise an annulus 12 the casing of well 11. For example, the annulus 12 is typically defined as the volumetric space located between the inner wall of the casing or production tubing and the exteriors of the other conduits. The carbon dioxide may be delivered to the burner by pumping it directly through the annulus 12.

Figure 3A:
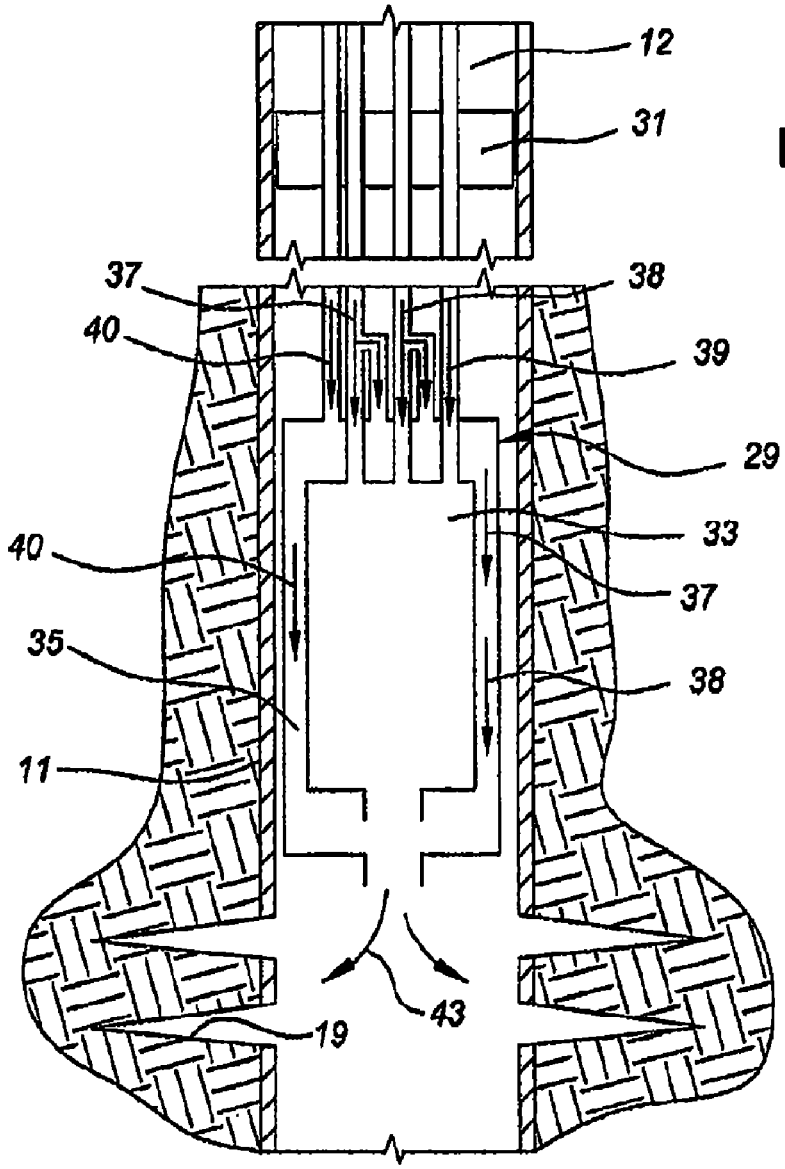
FIGS. 3A and 3B are schematic illustrations of a combustion device employed with the process of this invention.
Figure 3B:
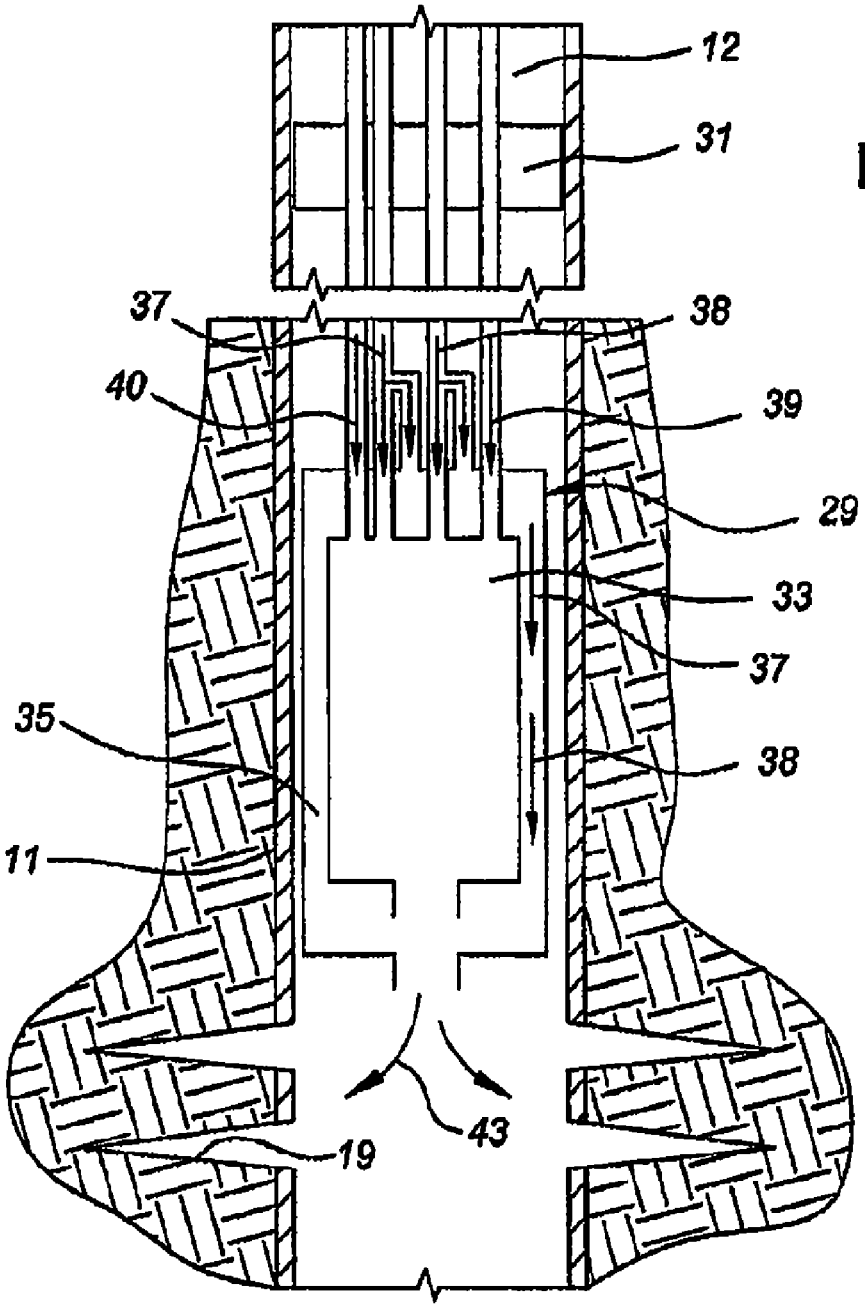

Combustion device or burner 29 is secured in well 11 for receiving the flow of fuel 37, steam 38, oxygen 39, and carbon dioxide 40. Burner 29 has a diameter selected so that it can be installed within conventional well casing, typically ranging from around seven to nine inches, but it could be larger. As illustrated in FIGS. 3A and 3B, a packer and anchor device 31 is located above burner 29 for sealing the casing of well 11 above packer 31 from the casing below packer 31. The conduits for fuel 37, steam 38, oxygen 39, and carbon dioxide 40 extend sealingly through packer 31. Packer 31 thus isolates pressure surrounding burner 29 from any pressure in well 11 above packer 31. Burner 29 has a combustion chamber 33 surrounded by a jacket 35, which may be considered to be a part of burner 29. Fuel 37 and oxygen 39 enter combustion chamber 33 for burning the fuel. Steam 38 may also flow into combustion chamber 33 to cool burner 29. Preferably, carbon dioxide 40 flows through jacket 35, which assists in cooling combustion chamber 33, but it could alternatively flow through combustion chamber 33, which also cools chamber 33 because carbon dioxide does not burn. If fuel 37 is hydrogen, some of the hydrogen can be diverted to flow through jacket 35. Steam 38 could flow through jacket 35, but preferably not mixed with carbon dioxide 40 because of the corrosive effect. Burner 29 ignites and burns at least part of fuel 37, which creates a high temperature in burner 29. Without a coolant, the temperature would likely be too high for burner 29 to withstand over a long period. The steam 38 flowing into combustion chamber 33 reduces that temperature. Also, preferably there is a small excess of fuel 37 flowing into combustion chamber 33. The excess fuel does not burn, which lowers the temperature in combustion chamber 33 because fuel 37 does not release heat unless it burns. The excess fuel becomes hotter as it passes unburned through combustion chamber 33, which removes some of the heat from combustion chamber 33. Further, carbon dioxide 40 flowing through jacket 35 and any hydrogen that may be flowing through jacket 35 cool combustion chamber 33. A downhole burner for burning fuel and injecting steam and combustion products into an earth formation is shown in U.S. Pat. No. 5,163,511.

Steam 38, excess portions of fuel 37, and carbon dioxide 40 lower the temperature within combustion chamber 33, for example, to around 1,600 degrees F., which increases the temperature of the partially-saturated steam flowing through burner 29 to a superheated level. Superheated steam is at a temperature above its dew point, thus contains no water vapor. The gaseous product 43, which comprises superheated steam, excess fuel, carbon dioxide, and other products of combustion, exits burner 29 preferably at a temperature from about 550 to 700 degrees F.

The hot, gaseous product 43 is injected into fractured zone 21 due to the pressure being applied to the fuel 37, steam 38, oxygen 39 and carbon dioxide 40 at the surface. The fractures within fractured zone 21 increase the surface contact area for these fluids to heat the formation and dissolve into the heavy oil to lower the viscosity of the oil and create solution gas to help drive the oil back to the well during the production cycle. The unfractured surrounding portion of formation 15 can be substantially impenetrable by the gaseous product 43 because the unheated heavy oil or tar is not fluid enough to be displaced. The surrounding portions of unheated heavy-oil formation 15 thus can create a container around fractured zone 21 to impede leakage of hot gaseous product 43 long enough for significant upgrading reactions to occur to the heavy oil within fractured zone 21.

If fuel 37 comprises hydrogen, the unburned portions being injected will suppress the formation of coke in fractured zone 21, which is desirable. The hydrogen being injected could come entirely from excess hydrogen supplied to combustion chamber 33, which does not burn, or it could be hydrogen diverted to flow through jacket 35. However, hydrogen does not dissolve as well in oil as carbon dioxide does. Carbon dioxide, on the other hand, is very soluble in oil and thus dissolves in the heavy oil, reducing the viscosity of the hydrocarbon and increasing solution gas. Elevating the temperature of carbon dioxide 40 as it passes through burner 29 delivers heat to the formation, which lowers the viscosity of the hydrocarbon it contacts. Also, the injected carbon dioxide 40 adds to the solution gas within the reservoir. Maintaining a high injection temperature for hot gaseous product 43, preferably about 700 degrees F., enhances pyrolysis and hydrovisbreaking if hydrogen is present, which causes an increase in API gravity of the heavy oil in situ.

Simulations indicate that injecting carbon dioxide and hydrogen into a heavy-oil reservoir that has undergone fracturing is beneficial. In three simulations, carbon dioxide at 1%, 10%, and 25% by moles of the steam and hydrogen being injected were compared to each other. The comparison employed two years of cyclic operation with 21 days of soaking per cycle. The results are as follows:

| Simulation | % C02 | Cumulative Oil Produced | Steam/Oil Ratio |
|---|---|---|---|
| 1. No Fracture | 0 | 3,030 | 14.3 |
| 2. Fracture | 1 | 9,561 | 13.2 |
| 3. Fracture | 10 | 20,893 | 8.99 |
| 4. Fracture | 25 | 22,011 | 5.65 |

The table just above shows that 25% carbon dioxide is better than 10% carbon dioxide for production and steam/oil ratio. Preferably, the carbon dioxide percentage injected into the reservoir is 10% to 25% or more, by moles of the steam and hydrogen being injected, but is at least 5%.

In the preferred method, the delivery of fuel 37, steam 38, oxygen 39 and carbon dioxide 40 into burner 29 and the injection of hot gaseous product 43 into fractured zone 21 occur simultaneously over a selected period, such as seven days. While gaseous product 43 is injected into fractured zone 21, the temperature and pressure of fractured zone 21 increases. At the end of the injection period, fractured zone 21 is allowed to soak for a selected period, such as 21 days. During the soak interval, the operator may intermittently pump fuel 37, steam 38, oxygen 39 and carbon dioxide 40 to burner 29 where it burns and the hot combustion gases 43 are injected into formation 15 to maintain a desired pressure level in fractured zone 21 and offset the heat loss to the surrounding formation. No further injection of hot gaseous fluid 43 occurs during the soak period.

Then, the operator begins to produce the oil, which is driven by reservoir pressure and preferably additional solution-gas pressure. The oil is preferably produced up the production tubing, which could also be one of the conduits through which fuel 37, steam 38, or carbon dioxide 49 is pumped. Preferably, burner 29 remains in place, and the oil flows through parts of burner 29. Alternatively, well 11 could include a second borehole a few feet away, preferably no more than about 50 feet, with the oil flowing up the separate borehole rather than the one containing burner 29. The second borehole could be completely separate and parallel to the first borehole, or it could be a sidetracked borehole intersecting and extending from the main borehole.

Figure 2:
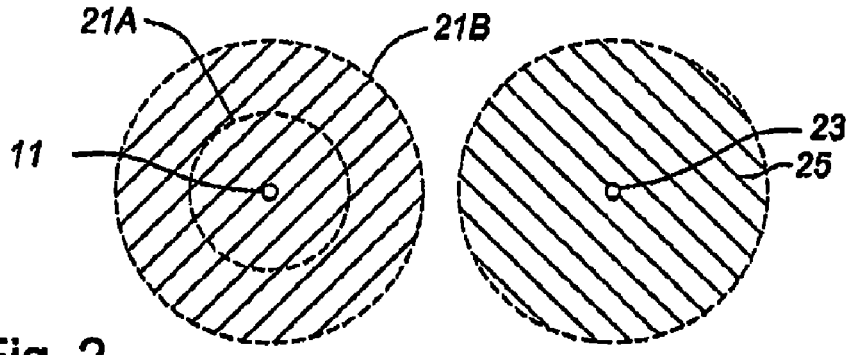
FIG. 2 is a schematic illustrating the well of FIG. 1 next to an adjacent well, which may also be produced in accordance with this invention.

The oil production will continue as long as the operator deems it feasible, which could be up to 35 days or more. When production declines sufficiently, the operator may optionally repeat the injection and production cycle either with or without additional fracturing. It may be feasible to extend the fracture in subsequent injection and production cycles to increase the perimeter 21*a* of fractured zone 21, then repeat the injection and production cycle described above. Preferably, this additional fracturing operation can take place without removing burner 29, although it could be removed, if desired. The process may be repeated as long as fractured zone 21 does not intersect fractured zones or drainage areas 25 of adjacent wells 23 (FIG. 2).

By incrementally increasing the fractured zone 21 diameter from a relatively small perimeter up to half the distance to adjacent well 23 (FIG. 2), the operator can effectively produce the viscous hydrocarbon formation 15. With each new fracturing operation, the previously fractured portion would provide flow paths for the injection of hot gaseous product 43 and the flow of the hydrocarbon into the well. Also, the previously fractured portion retains heat from the previous injection of hot combustion gases 43. The numeral 21*b* in FIGS. 1 and 2 indicates the perimeter of fractured zone 21 after a second fracturing process. The operator could be performing similar fracturing, injection, soaking and production cycles on well 23 at the same time as on well 11, if desired. The cycles of injection and production, either without or without additional fracturing may be repeated as long as feasible.

Before or after reaching the maximum limit of fractured zone 21, which would be greater than perimeter 21*b*, the operator may wish to convert well 11 to a continuously-driven system. This conversion might occur after well 11 has been fractured several different times, each increasing the dimension of the perimeter. In a continuously-driven system, well 11 would be either a continuous producer or a continuous injector. If well 11 is a continuous injector, downhole burner 29 would be continuously supplied with fuel 37, steam 38, oxygen 39, and carbon dioxide 40, which burns the fuel and injects hot gaseous product 43 into fractured zone 21. The hot gaseous product 43 would force the oil to surrounding production wells, such as in an inverted five or seven-spot well pattern. Each of the surrounding production wells would have fractured zones that intersected the fractured zone 21 of the injection well. If well 11 is a continuous producer, fuel 37, steam 38, oxygen 39, and carbon dioxide 40 would be pumped to downhole burners 29 in surrounding injection wells, as in a normal five- or seven-spot pattern. The downhole burners 29 in the surrounding injection wells would burn the fuel and inject hot gaseous product 43 into the fractured zones, each of which joined the fractured zone of the producing well so as to force the oil to the producing well.

The invention has significant advantages. The injection of carbon dioxide along with steam and unburned fuel into the formation increases the resulting heavy-oil production. Heating the carbon dioxide as it passes through the burner increases the temperature of the fractured heavy-oil formation. The carbon dioxide also adds to the solution gas in the formation. The unfractured, heavy-oil formation surrounding the fractured zone impedes leakage of excess fuel, steam and other combustion products into adjacent formations or to the surface long enough for significant upgrading reactions to occur to the heavy oil in the formation. The container maximizes the effects of the excess fuel and other hot gases flowing into the fractured zone. By reducing leakage from the fractured zone, the expense of the fuel, oxygen, and steam is reduced. Also, containing the excess fuel increases the safety of the well treatment. At least part of the fuel, carbon dioxide and heat contained in the produced fluids may be recycled.

While the invention has been shown in only one of its forms, it should be apparent to those skilled in the art that it is not so limited but is susceptible to various changes without departing from the scope of the invention. For example, the fractures could be vertical rather than horizontal. In addition, although the well is shown to be a vertical well in FIG. 1, it could be a horizontal or slanted well. The fractured zone could be one or more vertical or horizontal fractures in that instance. The burner could be located within the vertical or the horizontal portion. The system could include a horizontal injection well and a separate horizontal production well with a slotted liner located a few feet below and parallel to the horizontal portion of the injection well. In some formations, fracturing may not be needed.

The invention claimed is:

1. A method for producing viscous hydrocarbons from a reservoir, comprising:

positioning a burner in a first well, wherein the burner includes a combustion chamber;

supplying a fuel, an oxidant and one of water or steam from the surface to the burner in the first well;

supplying carbon dioxide from the surface to the burner in a conduit separate from the fuel;

igniting the fuel and the oxidant in the combustion chamber to generate heat and steam in the burner;

injecting carbon dioxide and steam from the burner into the reservoir to heat hydrocarbons within the reservoir; and recovering hydrocarbons from the reservoir through a second well that is spaced from the first well.

2. The method of claim 1, further comprising flowing the carbon dioxide through a jacket surrounding the combustion chamber.

3. The method of claim 1, further comprising flowing the carbon dioxide through the combustion chamber.

4. The method of claim 1, further comprising flowing the at least one of water or steam through a jacket surrounding the combustion chamber.

5. The method of claim 1, further comprising flowing the at least one of water or steam through the combustion chamber.

6. The method of claim 1, further comprising injecting a gaseous product comprising carbon dioxide and steam into the reservoir at a temperature of about 550 degrees Fahrenheit to about 700 degrees Fahrenheit.

7. The method of claim 6, wherein the gaseous product further comprises at least one of superheated steam and excess fuel.

8. The method of claim 1, wherein the fuel comprises at least one of hydrogen, methane, and syngas.

9. The method of claim 1, wherein the fuel, the oxidant, and the carbon dioxide are supplied from the surface to the burner in separate conduits.

10. The method of claim 1, wherein the first well and the second well comprise at least one of a vertical well, a horizontal well, and a slanted well.

11. The method of claim 1, further comprising elevating the temperature of the carbon dioxide as it passes through the burner to deliver heat to the reservoir.

12. The method of claim 1, further comprising injecting a gaseous product comprising carbon dioxide and steam into the reservoir, wherein the gaseous product comprises about 1 percent to about 25 percent by moles of carbon dioxide, and wherein a steam-to-oil ratio of production is about 5.65 to about 13.20.

13. The method of claim 1, further comprising allowing the reservoir to soak with the carbon dioxide and steam for about 21 days before recovering hydrocarbons through the second well.

14. The method of claim 1, further comprising using the carbon dioxide to reduce the viscosity of hydrocarbons in the reservoir and increase formation pressure in the reservoir.

15. The method of claim 14, further comprising using the formation pressure in the reservoir to force hydrocarbons into and up the second well.

16. The method of claim 15, further comprising fracturing the reservoir to create a fractured zone surrounded by an unfractured portion of the reservoir, and when the recovery of hydrocarbons declines to a selected minimum level, fracturing the reservoir again to increase the dimensions of the fractured zone.

17. The method of claim 1, wherein the heat generated in the combustion chamber raises the combustion chamber temperature to at least 1,600 degrees Fahrenheit to thereby generate superheated steam in the burner.

18. A method for producing viscous hydrocarbons from a reservoir, comprising:

positioning a burner in a first well, wherein the burner includes a combustion chamber;

supplying a fuel, an oxidant, and one of water or steam from the surface to the burner in the first well;

supplying carbon dioxide from the surface to the reservoir in a conduit separate from the fuel, the oxidant, and the at least one of water or steam;

igniting the fuel and the oxidant in the combustion chamber to generate heat and steam in the burner;

injecting carbon dioxide and steam into the reservoir to heat hydrocarbons within the reservoir; and recovering hydrocarbons from the reservoir through a second well that is spaced from the first well.

19. The method of claim 18, further comprising injecting a gaseous product comprising carbon dioxide and steam into the reservoir, wherein the gaseous product comprises about 1 percent to about 25 percent by moles of carbon dioxide, and wherein a steam-to-oil ratio of production is about 5.65 to about 13.20.

20. The method of claim 18, further comprising elevating the temperature of the carbon dioxide as it passes through the burner to deliver heat to the reservoir, and using the carbon dioxide to reduce the viscosity of hydrocarbons in the reservoir and increase formation pressure in the reservoir.

21. The method of claim 20, further comprising using the formation pressure in the reservoir to force hydrocarbons into and up the second well.

22. The method of claim 18, further comprising flowing the carbon dioxide through a jacket surrounding the combustion chamber.

* * * * *

UNITED STATES PATENT AND TRADEMARK OFFICE

CERTIFICATE OF CORRECTION

PATENT NO. : 8,286,698 B2
APPLICATION NO. : 13/253783
DATED : October 16, 2012
INVENTOR(S) : Ware et al.

It is certified that error appears in the above-identified patent and that said Letters Patent is hereby corrected as shown below:

In Detailed Description:

Column 4, Line 18, please insert --in-- after 12.

Signed and Sealed this
Twenty-sixth Day of February, 2013

Teresa Stanek Rea
*Acting Director of the United States Patent and Trademark Office*